US010244826B2

(12) United States Patent
Lehman

(10) Patent No.: US 10,244,826 B2
(45) Date of Patent: Apr. 2, 2019

(54) APPARATUS FOR SECURING A MARTIAL ARTS BELT

(71) Applicant: Wendy P. Lehman, West Chester, PA (US)

(72) Inventor: Wendy P. Lehman, West Chester, PA (US)

( * ) Notice: Subject to any disclaimer, the term of this patent is extended or adjusted under 35 U.S.C. 154(b) by 11 days.

(21) Appl. No.: 15/479,913

(22) Filed: Apr. 5, 2017

(65) Prior Publication Data

US 2018/0249790 A1 Sep. 6, 2018

Related U.S. Application Data

(60) Provisional application No. 62/467,203, filed on Mar. 5, 2017.

(51) Int. Cl.

| | |
|---|---|
| ***A44B 1/04*** | (2006.01) |
| ***A44B 11/04*** | (2006.01) |
| ***A41F 9/00*** | (2006.01) |

(52) U.S. Cl.

CPC ..... *A44B 11/04* (2013.01); *A41F 9/002* (2013.01)

(58) Field of Classification Search

CPC ..... A44B 11/04; A41F 9/002

See application file for complete search history.

(56) References Cited

U.S. PATENT DOCUMENTS 4,496,045 A * 1/1985 Ferguson ..... A61B 17/06138 206/476
4,813,902 A * 3/1989 Messer ..... B42D 15/02 40/124.15
5,299,325 A * 4/1994 Kamber ..... A41F 9/002 2/338
5,560,477 A * 10/1996 Scanlon ..... A61B 17/06138 206/382
5,725,620 A * 3/1998 Perea ..... A47L 9/1445 15/347
5,772,019 A * 6/1998 Reed ..... B65D 85/544 206/308.1
7,730,925 B1 * 6/2010 Pereira ..... E06B 9/262 160/348
2002/0175091 A1 * 11/2002 Williamson, IV ..... A61B 17/06138 206/63.3
2004/0046010 A1 * 3/2004 Colvin, Jr. ..... B65D 27/06 229/92.1
2012/0123472 A1 * 5/2012 Culligan ..... A61B 17/06114 606/224
2015/0014401 A1 * 1/2015 Wyko ..... B65D 27/20 229/77
2015/0343251 A1 * 12/2015 Ferguson, Jr. ... A63B 21/00185 482/131

(Continued)

*Primary Examiner* — Robert Sandy
*Assistant Examiner* — David M Upchurch
(74) *Attorney, Agent, or Firm* — Axenfeld Law Group LLC

(57) ABSTRACT

Described is an apparatus for keeping a martial arts belt secured around a student regardless of whether the knot of the belt becomes untied or not. The apparatus includes a flexible rectangularly-shaped sheet of material having first, second and third panels, which encircle a portion of the martial arts belt centered around an area of the belt where the knot is tied, when the apparatus is attached to the belt. A portion of the martial arts belt, which is used by the student to tie the knot, and/or the knot itself, extends transversely through at least a portion of hole(s) of the apparatus.

18 Claims, 5 Drawing Sheets

(56) References Cited

U.S. PATENT DOCUMENTS

2016/0053525 A1* 2/2016 McMurray ..... E05G 1/005
150/130

* cited by examiner

APPARATUS FOR SECURING A MARTIAL ARTS BELT

CROSS REFERENCE TO RELATED APPLICATIONS

This application claims the benefit of U.S. Provisional Patent Application No. 62/467,203, filed on 5 Mar. 2017, entitled "APPARATUS FOR SECURING A MARTIAL ARTS BELT," the entirety of which is hereby incorporated by reference.

BACKGROUND

Most participants in martial arts wear a uniform when practicing their martial art. The top portion of the uniform may include a robe, which is held closed by a belt positioned around the waist of the participant (hereinafter the "student") who trains in the martial arts. Typically, the belt is wrapped multiple times around the waist of the student, and then tied in the front with a special knot.

Most students must first learn how to properly tie their belt before beginning their first formal lesson. However, many new students—especially children—have difficulty mastering how to tie the knot. Often an instructor or more experienced student is needed to help the new student tie or retie their belt over many weeks and months.

Another problem that afflicts all students of the martial arts regardless of age or experience, is that their knot often becomes loose, and unravels while either participating in class, training, or competition. After the knot loosens, the belt begins to unwrap, and often falls off the student on to the ground. During a class or competition this can create an irritant to the student. That is, the student may waste time continually retying their belt. Other annoyances include tripping over a belt that has fallen off, or becoming entangled with a loose belt while grappling. To the student's dismay, each time the belt is retied, he or she often finds that the knot loosens again, falls off, and then the process repeats itself multiple times per class, training, or competition. The problem is exacerbated in a children's class, where an instructor is often interrupted with the need to continually help students retie their belts.

SUMMARY

Described is an apparatus for keeping a martial arts belt secured around a student regardless of whether a knot of the belt becomes untied or not. In one aspect, the apparatus does not interfere with the student's ability to tie or untie the knot.

In one embodiment, the apparatus includes a flexible rectangularly-shaped sheet of material (or other suitable shapes) having first, second and third panels. The first panel and the third panel hingedly fold inwardly toward the second panel. A hole is located in a central portion of the second panel. A fastening mechanism fastens the first and third panels together when the first panel and third panel are folded inwardly toward to the second panel. The first, second, and third panels are configured to encircle a portion of the martial arts belt where the knot is tied, with a portion of the martial arts belt sandwiched between the second panel on one side (the front visible portion) of the martial arts belt, and the first and third panels on the other side (backside) of the belt abutting the student's abdomen area.

The knot of the martial arts belt may extend—fully or partially—through the hole of the second panel when the apparatus is fastened around the belt. In other words, the knot may fully pass through the hole of the second panel—or the knot may be trapped between the first/third panels on one side of the knot, and strips of material of the second panel surrounding the hole, on the other side of the knot. In the latter example, the knot may extend partially through the hole when the apparatus is fastened around the belt on or around the knot.

In a second embodiment, the apparatus includes a flexible rectangularly-shaped sheet of material (or other suitable shapes) having first, second and third panels. The first panel and the third panel hingedly fold inwardly toward the second panel. Holes are located in a central portion of the first and third panels. A fastening mechanism located on a portion of material surrounding the holes of the first and third panels, fastens the first and third panels together when the first panel and third panel are folded inwardly toward to the second panel.

In the second embodiment, the first, second, and third panels are configured to encircle a portion of the martial arts belt where the knot is tied, with a portion of the martial arts belt sandwiched between the second panel on one side (in this case on the backside or non-visible portion) of the martial arts belt when worn by a student, and the first and third panels on the other side of the belt (the front/visible side of the belt).

In the second embodiment, the knot of the martial arts belt may extend—fully or partially—through the holes of the first and third panels when the apparatus is fastened around the belt. In other words, the knot may fully pass through the holes of first and third panels; or the knot may be trapped between the second panel on one side of the knot, and strips of material of the first and third panels surrounding the holes, on the other side of the knot. In the latter example, the knot may extend partially through the holes when the apparatus is fastened around the belt on or around the knot.

This summary is not necessarily intended to identify key features or essential features of the claimed subject matter, nor is it necessarily intended to be used as an aid in determining the scope of the claimed subject matter.

The foregoing outlines examples of this disclosure so that those skilled in the relevant art may better understand the detailed description that follows. Additional embodiments and details will be described hereinafter. Those skilled in the relevant art should appreciate that they can readily use any of these disclosed embodiments as a basis for designing or modifying other structures or functions for carrying out the invention, without departing from the spirit and scope of the invention.

Reference herein to "one embodiment", "an embodiment", "an implementation" "an example," "an aspect," or similar formulations herein, means that a particular feature, structure, operation, or characteristic described in connection with the embodiment, is included in at least one embodiment of the present invention. Thus, different appearances of such phrases or formulations herein do not necessarily refer to the same embodiment. Furthermore, various particular features, structures, operations, or characteristics may be combined in any suitable manner in one or more embodiments.

BRIEF DESCRIPTION OF THE DRAWINGS

The detailed description is described with reference to the accompanying figures. In the figures, the left-most digit(s) of a reference number identifies the figure in which the reference number first appears. The figures are not necessarily drawn to scale.

FIG. 1 shows one embodiment of an apparatus having a flexible rectangularly-shaped sheet of material.

FIG. 2 shows a first panel folded over a second panel (not visible in FIG. 2) along a crease in the material.

FIG. 3 shows a third panel folded over the first panel (not visible in FIG. 3), and the second panel (also not visible in FIG. 2), along another crease in the material.

FIG. 4 shows the apparatus secured around a martial arts belt worn by a student.

FIG. 5 shows an alternative embodiment of the apparatus, with two holes located in the outer panels.

DETAILED DESCRIPTION

Described is an apparatus for securing a knot of a martial arts belt.

1.0 Example Securing Mechanism with Center Panel Aperture

In one aspect, the apparatus includes a generally flexible material with three panels, a first panel, a center (i.e., "second") panel, and a third panel. The first panel and the third panel hingedly fold inward toward the center panel. A securing mechanism, such as Velcro (i.e., a hook and latch system), secure the first panel and the third panel to each other after the two panels are folded inward toward the center panel. The center panel includes an aperture. The height of each panel is large enough to accommodate the width of the martial art belt when the first, center, and third panels are secured around the belt, and the knot of the belt extends—fully or partially—through the aperture of the center panel. The center panel is placed in front of the belt, i.e., on the knot side of the belt.

Figure 1:
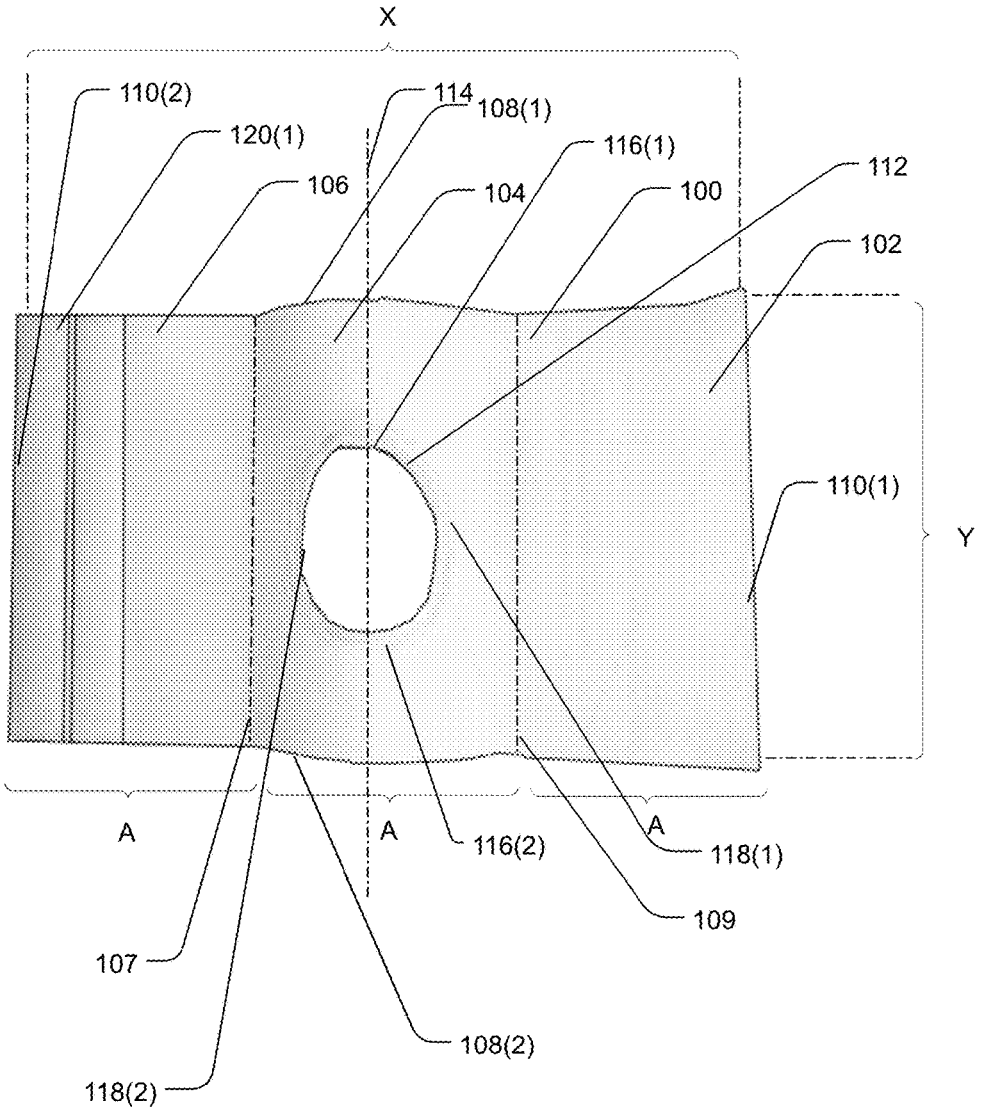
FIGS. 1 through 5 show different views of example apparatuses for securing a knot of a martial arts belt. Specifically.

FIG. 1 shows one embodiment of an apparatus 100 having a flexible rectangularly-shaped sheet of material. The sheet of material may be composed of any suitable flexible material, such as leather, canvas, polyester, cotton, hemp, vinyl, or a combination of the aforementioned materials.

In a fully opened position (i.e. generally flat and unfolded), the flexible rectangularly-shaped sheet of material has a first pair of generally parallel sides (also referred to as edges) 108(1), 108(2) each having a length X of about nine inches, and a second pair of generally parallel sides (or edges) 110(1), 110(2) having a length Y of about 4¾ inches. First pair of sides 108(1), 108(2), and second pair of sides 110(1), 110(2) are perpendicular to each other.

Apparatus 100 includes a first panel 102, a second panel (i.e., the central panel) 104, and a third panel 106. First panel 102 and third panel 106 fold inwardly toward second panel 104.

Panels 102, 104, and 106 are approximately an equal distance 'A', which in the illustrated embodiment is between about 2¾ inches and 3¼ inches for: panel 106 measured from edge 110(2) to crease 107; for panel 104 measured from crease 107 to crease 109; and for panel 102 measured from crease 109 to edge 110(1). Creases 107 and 109 allow panels 102 and 106 to hingedly fold along the axis of each crease toward panel 104. Crease 107 also serves as a demarcation line between panel 106 and panel 104. And crease 109 serves as a demarcation line between panel 102 and panel 104.

Figure 2:
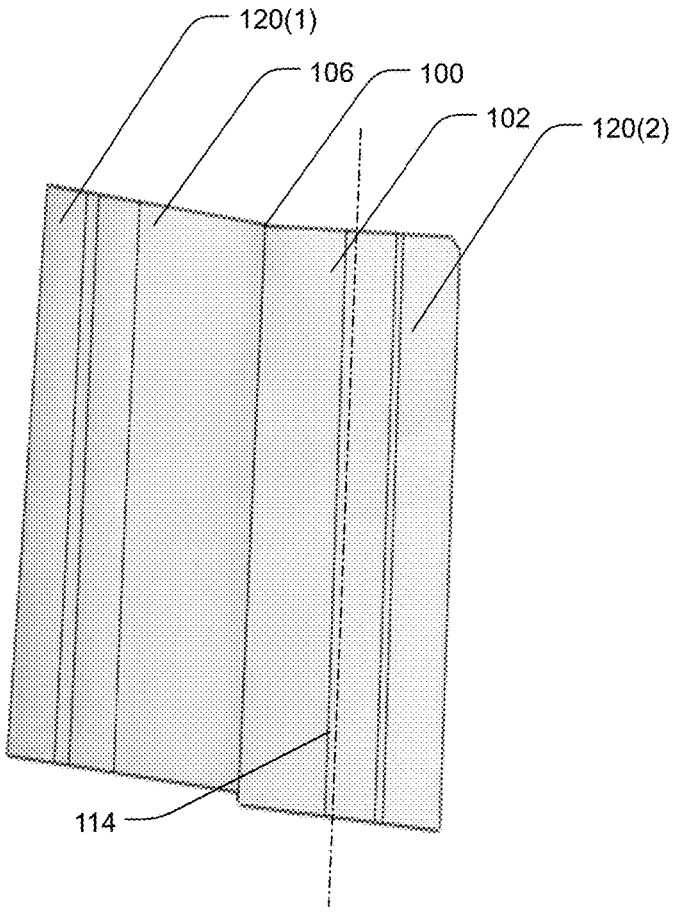

For instance, FIG. 2 shows first panel 102 folded over second panel 104 (not visible in FIG. 2) along crease 109.

Figure 3:
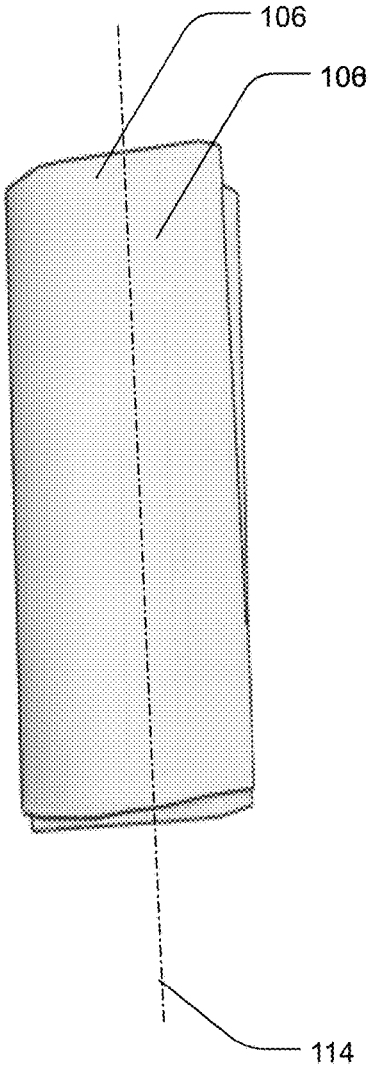

And FIG. 3 shows third panel 106 folded over first panel 102 (not visible in FIG. 3), and second panel 104 (also not visible in FIG. 2), along crease 107.

Referring back to FIG. 1, a hole 112 is located in a central portion of second panel 104, with material surrounding the hole 112 forming second panel 104.

For instance, in the illustrated embodiment, hole 112 has edges 116(1), 116(2), which are located about 1¼ inches from sides 108(1), 108(2), respectively. Hole 112 has other edges 118(1), 118(2), which are located about 3½ inches sides 110(1), 110(2) respectively. As appreciated by those skilled in the art, the exact distance of hole 112 from sides 108 or 110 may vary.

Hole 112 may be circular, elliptical, square, rectangular, or triangular in shape. As shown hole 112 is slightly elliptical. Hole 112 has a diameter of between about 1.5 inches and two inches along a horizontal axis 114, which corresponds to a central-horizontal axis of a martial arts belt (not shown in FIG. 1). Thus, it is appreciated by those skilled in the relevant art after having the benefit of reading this disclosure, that the exact size of hole 112 may vary, and that of its shape may also vary.

Apparatus 100 also includes Velcro strips 120(1) (FIG. 1), 120(2) (see FIG. 2) disposed on panels 106 and 102, respectively.

As shown in FIG. 3, Velcro strips 120(1), 120(2) fasten first panel 102 and third panel 106 together when first panel 102 and third panel 106 are folded inwardly toward to center panel 104. Velcro strips 120 may be placed in any suitable location on first panel 102 and third panel 106.

Figure 4:
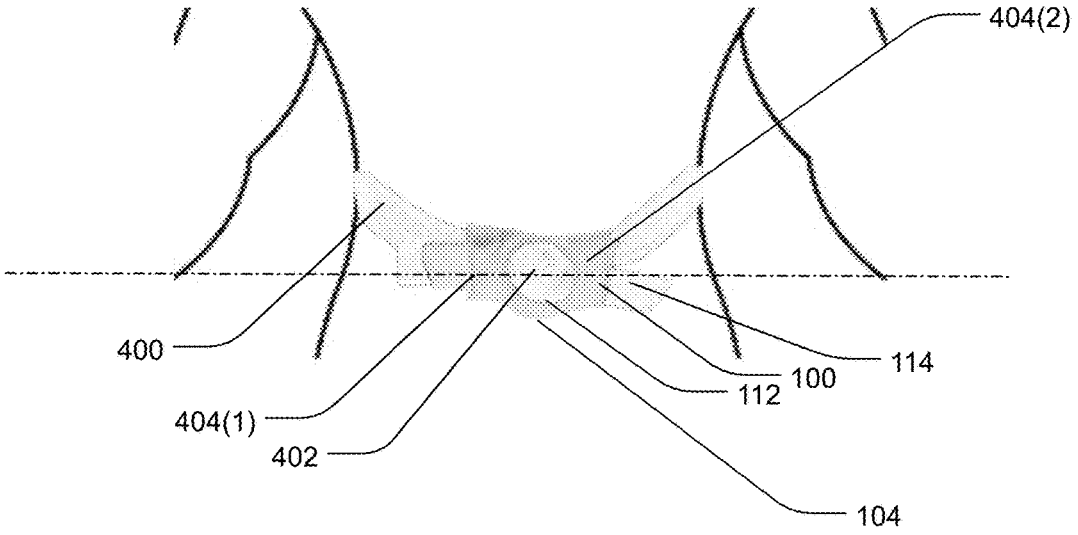

As shown in FIG. 4, apparatus 100 encircles a martial arts belt 400 when apparatus 100 is attached to belt 400. Specifically, knot 402 extends, at least partially through, hole 112 when apparatus 100 is fastened to belt 400. Solid portions 404(1), 404(2) of second panel 104 secure portions of belt 400 to the right and left of knot 402. A portion of belt 400 where apparatus is fastened to, is sandwiched between panel 104, and panels 102/106, which are behind the belt abutting the Gi of a student, and not visible in FIG. 4.

As appreciated by those skilled in the art after having the benefit of this disclosure, all dimensions are examples, and may be larger or smaller depending on the implementation and materials used. For example, it may be possible to reduce or increase the length of the sides X and Y by an inch, a ½ inch or a ¼ inch. Of course, these lengths are not exhaustive.

2.0 Example Securing Mechanism with Outer Panel Apertures

Figure 5:
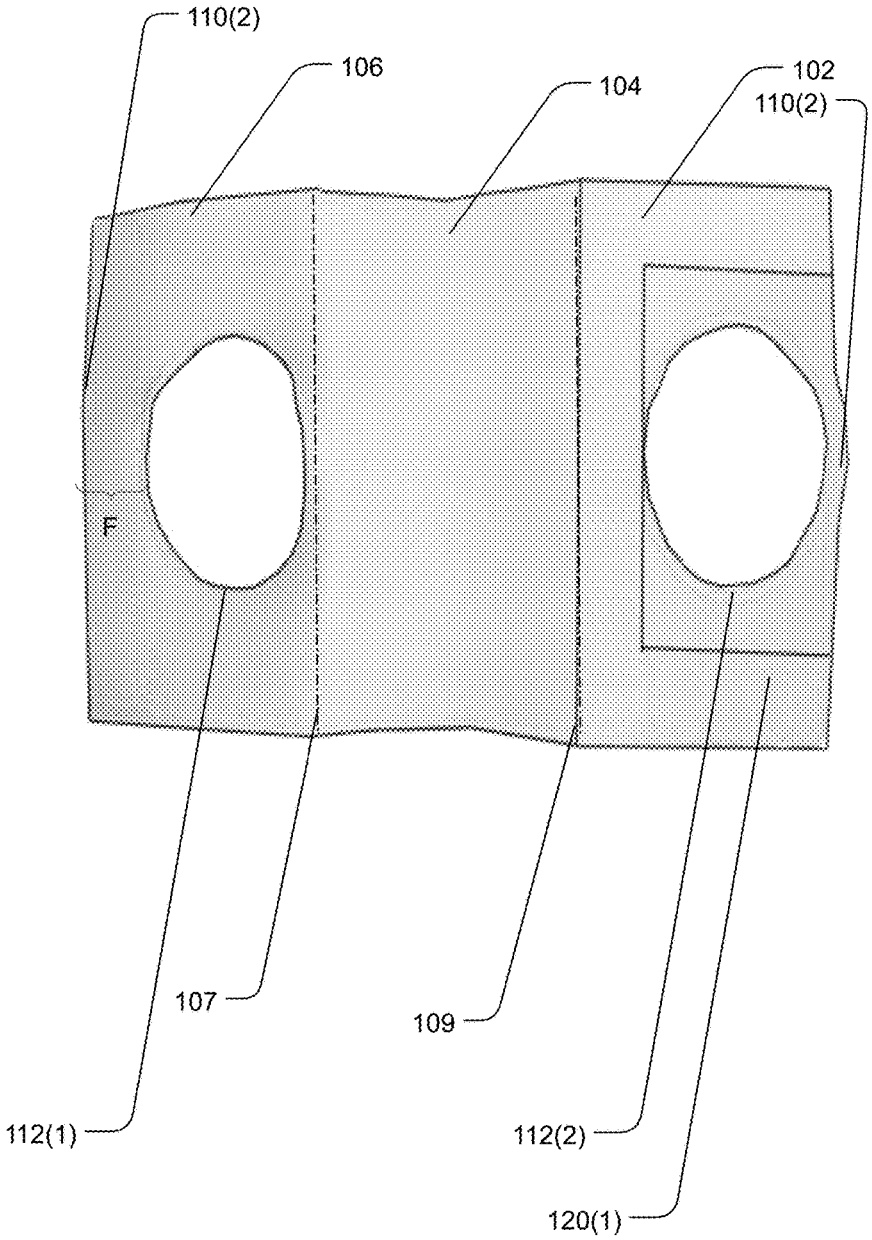

FIG. 5 shows another embodiment of apparatus 100. As illustrated in FIG. 5, apparatus 100 includes a flexible material with three panels: a first panel 102, a second panel 104, and a third panel 106. First panel 102 and third panel 106 hingedly fold inward toward second panel 104 along the axis of creases 109, 107. A securing mechanism, such as Velcro (hook and latch securing means) 120(1) and 120(2) (not visible in FIG. 5), secure first panel 102 and the third panel 106 to each other after they are folded inward toward second panel 104.

In the example of FIG. 5, first panel 102 and third panel 106 each include an hole 112(1), 112(2) for securing the knot of the martial arts belt therein. Whereas, second panel 104 is solid. Each Hole 112(1), 112(2) may be a distance 'F', i.e., about between a ¼ of an inch and one inch away from edges 110(1), 110(2). Otherwise the general position and dimensions of holes 112(1), 112(2) may correspond to those described above with reference to FIGS. 1-4.

The height of each panel 102, 104, 106 is large enough to accommodate the width of the martial art belt when the first, second and third panels are secured around the belt, and the knot of the belt is inserted through holes 112(1), 112(2) of first and second panels 102/106 (see FIG. 5). The sizes of panels and holes may be similar to those described in the first embodiment, which is illustrated in FIGS. 1-4.

In the illustrated embodiment of FIG. 5, second panel 104 is placed behind the belt (not shown)—i.e., opposite the knot side of the belt, when apparatus 100 is fastened to belt 400.

In the example embodiments above, the securing mechanism may include Velcro for fastening the first and third panels together when folded. In addition, as appreciated by those skilled in the relevant art after having the benefit of reading this disclosure, Velcro is nonlimiting. Other suitable fastening mechanisms may be used in lieu of Velcro such as, but not limited to: a snap system, buttons, adhesive, and or a combination of fastening mechanisms including Velcro. In addition, the fastening mechanism may be located in any suitable location disposed in, on, or around apparatus 100.

In another aspect, the color of the sheet of material of apparatus 100 may correspond to the color of the belt, such as white, blue, purple, brown or black, and so forth.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. An apparatus for securing a knot of a martial arts belt, comprising:

a flexible rectangularly-shaped sheet of material consisting of a first panel, a second panel, and a third panel; wherein the first panel and the third panel hingedly fold inwardly toward the second panel; and means for fastening the first and third panels together when the first panel and third panel are folded inwardly toward to the second panel;

wherein the second panel consisting of a single hole located in a central portion of the second panel;

wherein the first panel, the second panel, and the third panel are configured to encircle the martial arts belt when the apparatus is attached to the martial arts belt, wherein the hole is configured to allow a portion of the martial arts belt and/or the knot to extend, at least partially, through the hole when the apparatus is fastened to the belt.

2. The apparatus of claim 1, wherein the flexible rectangularly-shaped sheet of material when unfolded has a first pair of generally parallel sides each having a length of about 9 inches, and a second pair of generally parallel sides having a length of about 4¾ inches, wherein the first and second pair of sides are perpendicular to each other.

3. The apparatus of claim 1, wherein the first panel measures about 4¾ inches by 2¾ inches.

4. The apparatus of claim 1, wherein the second panel measures about 4¾ inches by 3¼ inches.

5. The apparatus of claim 2, wherein the hole is about 1¼ inches from an edge associated with at least one of the second pair of sides.

6. The apparatus of claim 2, where in the hole is about 3½ inches from an edge associated with at least one the first pair of sides.

7. The apparatus of claim 1, wherein in the hole is elliptical in shape.

8. The apparatus of claim 1, wherein the means for fastening the first and third panels together includes loop and hook strips disposed on the first and third panels.

9. An apparatus for securing a knot of martial arts belt, comprising:

a flexible rectangularly-shaped sheet of material consisting of a first panel, a second panel, and a third panel; wherein the first panel and the third panel fold inwardly toward the second panel; and means for fastening the first and third panels together when the first panel and third panel are folded inwardly toward the center panel;

wherein the first panel consisting of a single first hole located in a central portion of the first panel;

wherein the third panel consisting of a single second hole located in a central portion of the third panel;

wherein the first, second and third panels are configured to encircle the martial arts belt with the first and third panels separated from the second panel by the martial arts belt when the apparatus is fastened to the belt;

wherein the first and second holes are configured to allow a portion of the martial arts belt, which leads to the knot, and/or the knot to extend through them when the apparatus is fastened to the belt.

10. The apparatus of claim 9, wherein the flexible rectangularly-shaped sheet of material when unfolded has a first pair of generally parallel sides each having a length of about 9 inches, and a second pair of generally parallel sides having a length of about 4¾ inches, wherein the first and second pair of sides are perpendicular to each other.

11. The apparatus of claim 9, wherein the first panel measures about 4¾ inches by 3 inches.

12. The apparatus of claim 9, wherein the second panel measures about 4¾ inches by 3 inches.

13. The apparatus of claim 10, wherein the first and second holes are about 1¼ inches from an edge associated with at least one of the second pair of sides.

14. The apparatus of claim 10, where in the first and second holes are between about a ¼ inch and 1 inch from an edge associated with at least one the first pair of sides.

15. The apparatus of claim 9, wherein in the hole is elliptical in shape.

16. The apparatus of claim 9, wherein the means for securing the first and third panels together includes loop and hook strips disposed on the first and third panels.

17. The apparatus of claim 9, wherein the first and second holes have a diameter of about between two and 2¼ inches.

18. An apparatus for securing a knot of martial arts belt, comprising:

a flexible rectangularly-shaped sheet of material having first, second and third panels;

a securing mechanism for locking the first, second, and third panels around the belt;

wherein the second panel consisting of a single aperture for receiving the knot with the knot inserted transversely through the aperture.

* * * * *